United States Patent [19]

Chihana

[11] Patent Number: 4,528,885

[45] Date of Patent: Jul. 16, 1985

[54] TOUCH-RESPONSIVE APPARATUS IN ELECTRONIC MUSICAL INSTRUMENT

[75] Inventor: Masanobu Chihana, Hamamatsu, Japan

[73] Assignee: Nippon Gakki Seizo Kabushiki Kaisha, Hamamatsu, Japan

[21] Appl. No.: 558,607

[22] Filed: Dec. 6, 1983

[30] Foreign Application Priority Data

Dec. 9, 1982 [JP] Japan ..... 57-214662

[51] Int. Cl.[3] ..... G10H 3/00

[52] U.S. Cl. ..... 84/1.1; 84/1.27

[58] Field of Search ..... 84/1.27, 1.01, 1.1, 84/1.24

[56] References Cited

U.S. PATENT DOCUMENTS 4,067,253 1/1978 Wheelwright et al. ..... 84/1.01

4,301,704 11/1981 Nagai et al. ..... 84/1.22

*Primary Examiner*—Forester W. Isen

*Attorney, Agent, or Firm*—Spensley, Horn, Jubas & Lubitz

[57] ABSTRACT

A touch responsive apparatus in an electronic musical instrument for controlling a musical tone of the instrument detects an after-touch of a key touch such as the depth or force of a key depression after the key has been depressed, and generates an after-touch control signal to perform an after-touch control which varies quickly toward a predetermined target value independently of an detected after-touch to such an extent as will not generate a click, and which thereafter follows the detected after-touch.

9 Claims, 9 Drawing Figures

TOUCH-RESPONSIVE APPARATUS IN ELECTRONIC MUSICAL INSTRUMENT

BACKGROUND OF THE INVENTION

1. Field of the Invention

The present invention relates to a touch-responsive apparatus in an electronic musical instrument provided with a keyboard, and more particularly to such a touch-responsive apparatus which controls musical tones by detecting an after-touch such as depth or pressure of a key depression following or upon its complete depression.

2. Description of the Prior Art

There has been practiced so-called touch-responsive control for controlling tone volume, tone color and/or tone pitch in accordance with a key touch such as speed or depth of a key depression in order to improve the performance function of an electronic musical instrument. As one form of such touch-responsive control, there has been proposed a method such that the state of a key touch or pressure after it has been completely depressed once (such a key touch will hereinafter be called "after-touch") is detected, for example, by an after-touch sensor which is provided under the keyboard, to thereby control the tone volume, the tone color and/or the tone pitch of a musical tone (such a control will hereinafter be called "after-touch control").

As the above-mentioned after-touch sensor, there has been used, in general, a piezoelectric device or an electro-conductive rubber. An after-touch sensor which employs an electro-conductive rubber is disclosed in, for example, U.S. Pat. No. 3,784,935. An output signal of this after-touch sensor is utilized in elevating a sustain level, or in intensifying vibrato, or in varying a tone color by varying the filter cut-off frequency or the frequency modulation index which determines the spreading of harmonics.

Now, the output of an after-touch sensor, in general, is relatively gentle in its rise. Therefore, in case the volume of a musical tone is controlled by relying on the output of the after-touch sensor, there is brought about a delay in starting the sounding of the musical tone, so that there has been the problem that the sounding of musical tones tends to become unnatural.

SUMMARY OF THE INVENTION

It is, therefore, a primary object of the present invention to provide a touch-responsive apparatus for an electronic musical instrument, which greatly solves the above-mentioned problem and compensates for the delay at the rise of an output of an after-touch sensor and is capable of performing a satisfactory after-touch control.

The present invention also intends to provide a touch-responsive apparatus in an electronic musical instrument to perform after-touch control in such a manner that, at the time of starting a key depression, the after-touch control signal is caused to exert a quick up-rising variation up to a predetermined aimed level only to such an extent as will not cause a click in a musical tone under the after-touch control, to thereby compensate for the delay at the rise of the output of the after-touch sensor.

A further object of the present invention is to provide a touch-responsive apparatus in an electronic musical instrument which can use inexpensive after-touch sensors having poor rising characteristics and/or differences in rising characteristic. This object is attained by an arrangement such that an after-touch control signal for performing an after-touch control is caused, at the onset of a key depression, to vary quickly toward a predetermined aimed value independently of the output of the after-touch sensor and subsequently thereto to vary following the output of the after-touch sensor.

The above-mentioned predetermined level or value of an after-touch control signal can be set at, for example, (1) a value determined corresponding to, for example, mezzo forte (mf); (2) a value determined corresponding to a selected tone color; or (3) a value corresponding to a key touch up to the time a key is depressed completely such as either key depression intensity or key depression speed in the initial period of a key depression (such key touch is hereinafter called "initial touch"). In a preferred example, the predetermined value is set to (3) mentioned above. This is because generally in a musical instrument, when the output of an initial touch is large, the output of the after-touch is large also. According to such arrangement, the feeling of a strong rising accent as in a wind instrument can be expressed by an electronic musical instrument.

DETAILED DESCRIPTION OF THE PREFERRED EMBODIMENTS

Figure 1:
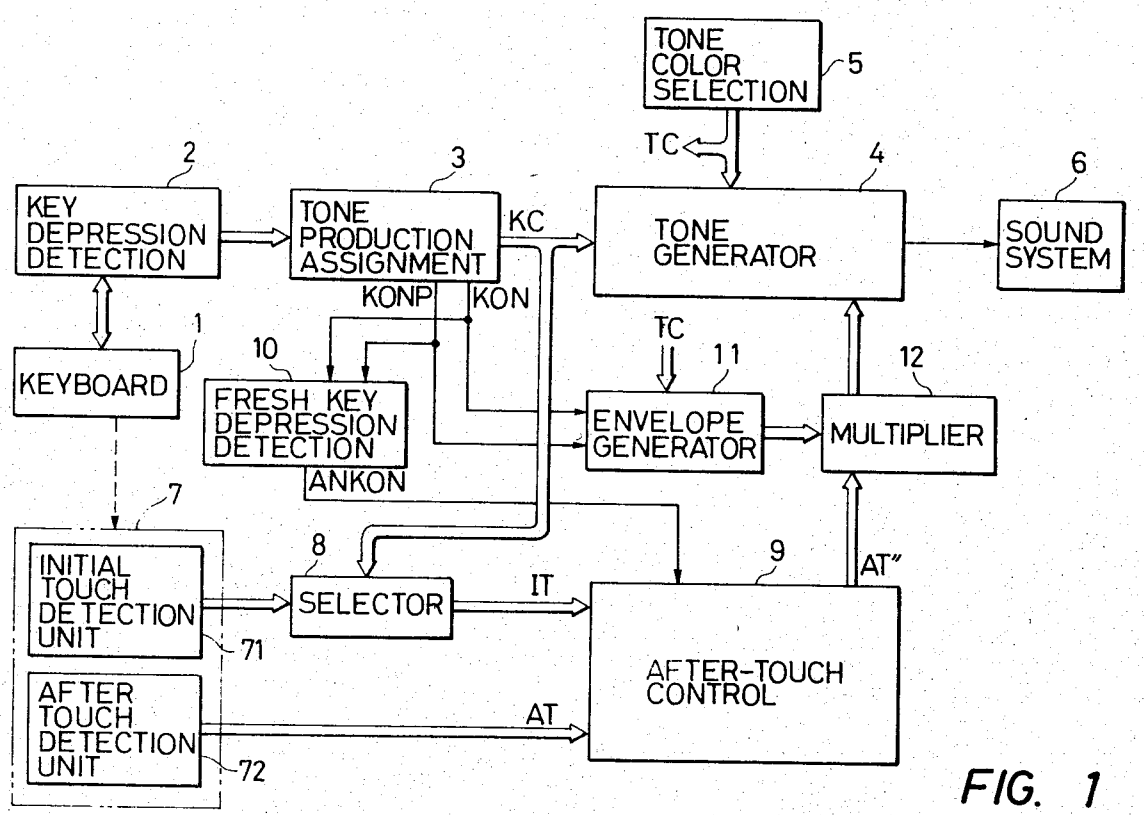
FIG. 1 is a block diagram showing the schematic arrangement of an electronic musical instrument to which the present invention is applied.

FIG. 1 is a block diagram showing an embodiment of the electronic musical instrument according to the present invention. A key depression detection circuit 2 detects a depressed key on a keyboard 1, and outputs a key information (hereinafter to be referred to as "key code KC") which is indicative of the depressed key. A tone production assignment circuit 3 assigns each depressed key on the keyboard to one of a plurality of musical tone generating channels based on the key code KC outputted from the key depression detection circuit 2, and outputs, time divisionally in synchronism with each channel timing, a key code KC indicative of the key assigned to each channel, a key-on signal KON indicative of whether the key depression is maintained or released, and a key-on pulse signal KONP indicative of the key depression timing. A musical tone signal generation circuit 4 generates, for each channel and based on the key code KC delivered from the tone production assignment circuit 3, a musical tone signal of a tone color determined by a tone color selection signal TC supplied from a tone color selection circuit 5.

On the other hand, the key touch at the time of a key depression is detected by a touch detection device 7. The initial touch is detected by such an initial touch detection unit 71 as disclosed in, for example, U.S. Pat. No. 3,819,844 or Japanese Patent Publication No. Sho 53-4418, which is preferably provided for each key especially when an initial touch signal is used to control an attack level of a produced tone. The after-touch is detected by a single after-touch detection unit 72 which is common to all the keys. These detection units 71 and 72 may be arranged for each key or a plurality of keys. The initial touch detection unit 71 parallelly outputs initial touch detection signals IT for respective depressed keys. Accordingly, a selector 8, from among these parallel initial touch detection signals IT, time-divisionally selects and outputs an initial touch detection signal IT corresponding to each key assigned to each channel, based on the key code KC outputted from the tone production assignment circuit 3.

It should be noted here that, in place of said initial touch detection unit 71 and said selector 8, arrangement may be made so that, as disclosed in U.S. Pat. No. 4,301,704, touch counters are provided in a number corresponding to the number of the channels to let them operate time divisionally in synchronism with a key code memory provided in the tone production assignment circuit 3. In such arrangement, the assignment of a depressed key is carried out at the time the depression of this key is started and concurrently contents of the touch counter of the channel assigned to the depressed key are cleared to thereby start counting appropriate pulses. This counting operation is stopped upon completion of the key depression so that the resultant count value is outputted as an initial touch detection signal IT.

An after-touch control circuit 9 receives an initial touch detection signal IT outputted from the selector 8 and also an after-touch detection signal AT outputted from the after-touch detection unit 72, and outputs an after-touch control signal AT″ through an operation which will be described later. It should be noted here that, in place of the initial touch detection signal IT, arrangement may be made to use a fixed value which is set correspondingly to a tone color indicated by the tone color selection signal TC.

A fresh key depression detection circuit 10 detects that either one of the keys of the keyboard 1 is depressed freshly from the state in which no key is depressed on the keyboard, based on the key-on signal KON and the key-on pulse signal KONP outputted from the tone production assignment circuit 3, and outputs, as a fresh key depression signal ANKON, the key-on pulse signal KONP of that channel to which the freshly depressed key is assigned. An envelope generator 11 time-divisionally generates, for each channel, based on either the key-on signal KON or the key-on pulse signal KONP, an envelope waveshape intended to control, for example, the tone volume envelope of the musical tone signal in accordance with a selected tone color. This envelope waveshape is multiplied, in a multiplier 12, by the after-touch control signal AT″ supplied from the after-touch control circuit 9, and is delivered to the musical tone signal generation circuit 4.

Figure 2:
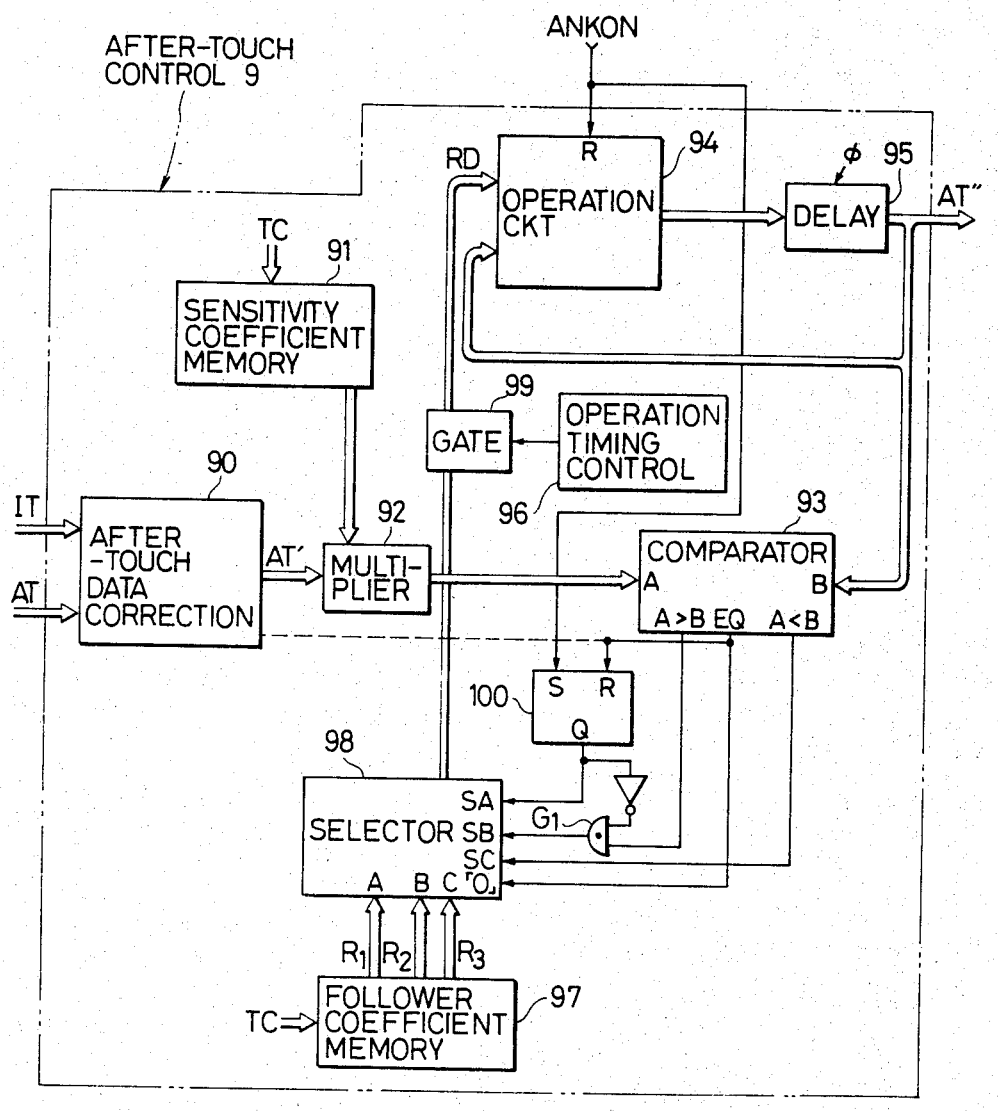
FIG. 2 is a block diagram showing the circuit arrangement of an example of the after-touch control circuit shown in FIG. 1.

FIG. 2 shows an embodiment of the after-touch control circuit 9 shown in FIG. 1. An after-touch data correction circuit 90 forms and outputs, based on the initial touch detection signal IT and the after-touch detection signal AT, a corrected after-touch signal AT′ whose initial value is fixed to the initial touch detection signal IT only for a predetermined length of time and thereafter it varies in accordance with the after-touch detection signal AT. The details of this after-touch data correction circuit 90 will be described later by referring to FIG. 3. The corrected after-touch signal AT′ is first subjected to sensitivity correction by a multiplier 92 in accordance with a sensitivity coefficient outputted from a sensitivity coefficient memory 91 in accordance with the selected tone color, and thereafter it is delivered to a terminal A of a comparator 93. On the other hand, to a terminal B of the comparator 93, there is inputted the output of an operation circuit 94 after being delayed by a delay circuit 95. The operation circuit 94 is reset each time a fresh key depression signal ANKON is generated, and performs an adding operation by the current value of the after-touch control signal AT″ outputted from the delay circuit 95 at the operation timing coming from an operation timing control circuit 96 to a follower coefficient RD, and outputs the resulting operation value ( AT″+RD ) as a fresh after-touch control signal AT″. The follower coefficient RD is comprised of positive follower coefficients $R_1$ and $R_2$ (wherein $R_1 > R_2$) and a negative follower coefficient $R_3$, which have been stored preliminarily in a follower coefficient memory 97. These follower coefficients $R_1$, $R_2$ and $R_3$ may be varied to correspond to a tone color selection signal TC. A selector 98 selects either one of the follower coefficients $R_1$, $R_2$ and $R_3$ outputted from the follower coefficient memory 97 in accordance with the result of comparison at the comparator 93 and also with the state of an R-S flip-flop 100, and delivers the selected one as a follower coefficient RD to the operation circuit 94 via a gate 99.

An embodiment of the after-touch data correction circuit 90 employed in the above-mentioned after-touch control circuit 9 is explained with reference to FIG. 3. The initial touch detection signal IT which is inputted time-divisionally in synchronism with the key code KC is latched by a latch 901 upon each generation of a fresh key depression signal ANKON and is inputted to a terminal A of a selector 902. The after-touch detection signal AT, on the other hand, is inputted to a terminal B of the selector 902. A timer circuit 903 starts time-counting operation upon generation of a fresh key depression signal ANKON, and outputs an end pulse EP upon termination of a set time (which is for example 50 ms~200 ms). An R-S flip-flop 904 is set by a fresh key depression signal ANKON and outputs "1" at a terminal Q, and is reset via an OR gate $G_2$ either when an end pulse EP is outputted from the timer circuit 903 or when a coincidence signal EQ is outputted from a comparator 905. The comparator 905 compares the after-touch detection signal AT with the initial touch detection signal IT which has been latched in the latch 901, and when there is a coincidence therebetween, it outputs "1" coincidence signal EQ.

Figure 3:
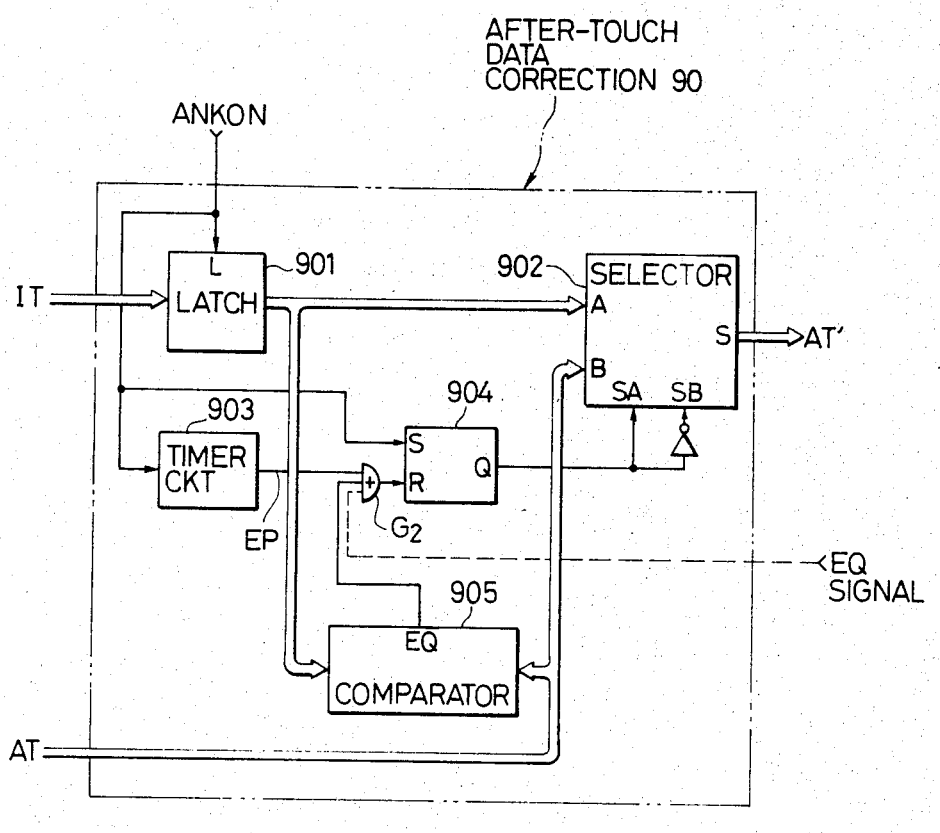
FIG. 3 is a block diagram showing the circuit arrangement of an example of the after-touch data correction circuit shown in FIG. 2.

Here, before describing the operation of the after-touch control circuit 9 shown in FIG. 2, the circuit operation of FIG. 3 is described with reference to FIGS. 2 and 4.

By a key depression, there are outputted from the tone production assignment circuit 3 a key code KC, a key-on signal KON and a key-on pulse signal KONP corresponding to the depressed key, of which the key code KC is delivered to the musical tone signal generation circuit 4. When, under the state that no key is depressed on the keyboard 1, a key is depressed freshly for the first time, this freshly depressed key is assigned to an appropriate channel by the tone production assignment circuit 3. In correspondence to this assignment, a fresh key depression signal ANKON (one-emission pulse signal) is outputted from the fresh key depression detection circuit 10 in synchronism with the channel timing of said assigned channel. On the other hand, in connection with the fresh key depression, there is generated, from the initial touch detection unit 71, an initial touch detection signal IT corresponding to the initial touch of this freshly depressed key. This detection signal IT is selected by the selector 8 in synchronism with the timing of said key's assigned channel, and it is applied to the after-touch control circuit 9. Also, from the after-touch detection unit 72 is generated an after-touch detection signal AT corresponding to the after-touch of the freshly depressed key. The envelope generator 11, on the other hand, generates, in synchronism with the key-on signal KON, an envelope waveshape corresponding to the tone color selection signal TC supplied from the tone color selection circuit 5.

In the after-touch data correction circuit 90, an initial touch detection signal IT concerning the freshly depressed key is latched in its latch 901. By the fresh key depression signal ANKON, the flip-flop 904 is set, and concurrently therewith, the timer circuit 903 starts a time-counting operation. As a result, a "1" signal is inputted to a terminal SA of the selector 902, so that the selector 902 outputs, as the initial value of the after-touch control signal AT', the input at the terminal A, i.e. the initial touch detection signal IT which has been latched in the latch 901. Let us here assume that the after-touch detection signal AT which is generated from the after-touch detection unit 72 varies in such fashion as shown by the broken line in FIG. 4A. Before the lapse of the time $t_0$ set by the timer circuit 903, the relationship between IT and AT will not become IT=AT. Accordingly, no coincidence signal EQ is outputted from the comparator 905. Thus, the flip-flop 904 is reset by the end pulse EP delivered from the timer circuit 903. As a result, when the set time $t_0$ has elapsed, the output at the terminal Q of the flip-flop 904 becomes "0", and "1" signal is inputted to the terminal SB of the selector 902. Therefore, the selector 902 selects the input at the terminal B, i.e. the after-touch detection signal AT, and outputs this signal as an after-touch control signal AT'. The after-touch control signal AT' which is outputted in this way from the after-touch control circuit 9 initially assumes the value of the initial touch detection signal IT as shown by the solid line in FIG. 4A, and thereafter (after the lapse of time $t_0$), it becomes a signal which varies correspondingly to the after-touch detection signal AT which in the illustrated example varies to fluctuate according to a pressure variation in the after-touch. Also, assuming that the after-touch detection signal AT has undergone a change as shown by the broken line shown in FIG. 4B, there will be established the relationship IT=AT before the lapse of time $t_0$ set by the timer circuit 903. Therefore, at such timing, a coincidence signal EQ is outputted from the comparator 905, and the flip-flop circuit 904 is reset by this coincidence signal EQ. Accordingly, the output of the selector 902 is switched over to the after-touch detection signal AT when IT=AT is established. As a result, the after-touch control signal AT' which is outputted from the after-touch control circuit 9 will become as shown by the solid line in FIG. 4B.

Figure 5:
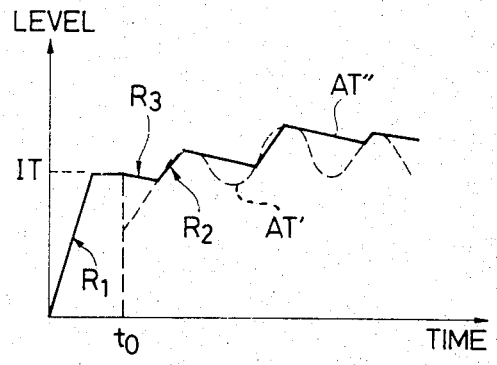
FIG. 5 is an output waveshape diagram of the after-touch control circuit shown in FIG. 2.

Referring now back to FIG. 2, the operation of the after-touch control circuit 9 will be explained by giving reference to FIG. 5.

Figure 4A:
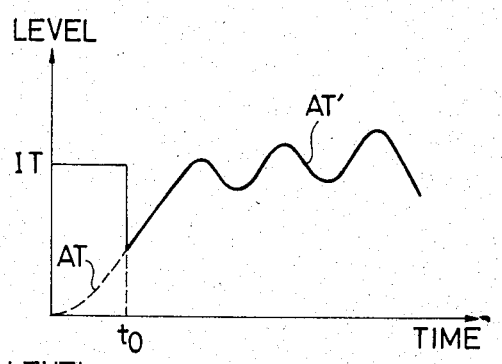
FIG. 4A and FIG. 4B are output waveshape diagrams of the after-touch data correction circuit shown in FIG. 3.
Figure 4B:
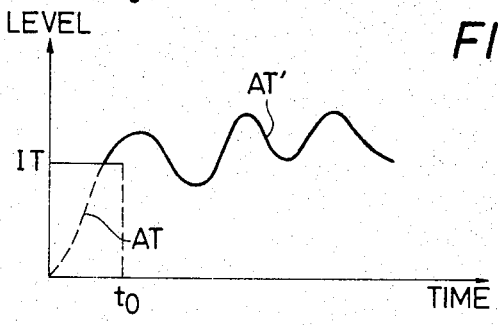

When a key is depressed, an initial touch detection signal IT and an after-touch detection signal AT which have been detected by the touch detection device 7 are inputted to the after-touch data correction circuit 90, where they are corrected and are outputted as a corrected after-touch signal AT' as shown in FIG. 4A or 4B. This corrected after-touch signal AT' is subjected to sensitivity correction by the sensitivity coeffcient stored in the sensitivity coefficient memory 91, and it is delivered to the terminal A of the comparator 93. On the other hand, the operation circuit 94 is reset by the fresh key depression signal ANKON, and concurrently the flip-flop 100 is set, and the output of its terminal Q becomes "1". As a result, the selector 98 selects, from among the follower coefficients $R_1$, $R_2$ and $R_3$ outputted from the follower coefficient memory 97, the input at the terminal A, i.e. the follower coefficient $R_1$, and transmits it to the operation circuit 94 via the gate 99. The operation circuit 94 makes an adding operation on the after-touch control signal AT of each time and the follower coefficient $R_1$ at a timing set by the operation timing control circuit 96, and outputs the operation value ( $AT''+R_1$ ) thereof as a fresh after-touch control signal AT''. As a result, the after-touch control signal AT'' augments at a relatively quick uprising rate which is determined by the follower coefficient $R_1$ as shown in FIG. 5. This follower coefficient $R_1$ is selected as large a value as will not cause a click to generate at the time of rising in the signal formation of a musical tone. During this period, the corrected after-touch signal AT' which is inputted to the terminal A of the comparator 93 is rendered to a constant level which is equal to the initial touch detection signal IT as will be noted from FIG. 4A and FIG. 4B. When the after-touch control signal AT'' which is mathematically operated and outputted by the operation circuit 94 becomes equal to the corrected after-touch signal AT' (initial detection signal IT), a coincidence signal EQ is outputted from the comparator 93, and the flip-flop 100 is reset, so that the output of its terminal Q becomes "0". As a result, the selector 98 selects "0" in lieu of the follower coefficent $R_1$ and delivers it to the operation circuit 94. Accordingly, the after-touch control signal AT'' does not undergo an augmentation or reduction until the time $t_0$ as shown in FIG. 5, and maintains the initial touch detection signal IT. When, subsequently, the corrected after-touch signal AT' decreases, the terminal A<B of the comparator 93 outputs a "1" signal, so that the selector 98 selects the input at the terminal C, i.e. the follower coefficient $R_3$ (negative value). As a result, the after-touch control signal AT'' which is mathematically operated and outputted by the operation circuit 94 begins to decrease gently at a relatively small falling rate. When, subsequently, the after-touch control signal AT'' becomes equal to the corrected after-touch signal AT', a coincidence signal EQ is outputted again from the comparator 93, and the selector 98 selects a follower coefficient "0", so that the decrease of the after-touch control signal AT'' ceases. When, subsequently, there is established the relationship: corrected after-touch signal AT'> after-touch control signal AT'', there is outputted a "1" signal from the terminal A > B of the comparator 93. At such time, the flip-flop 100 remains in its reset state which has been fixed by the above-mentioned coincidence signal EQ. Therefore, the output at its terminal Q is "0". Accordingly, the AND condition of the AND gate $G_1$ is established, and the selector 98 selects the input of its terminal B, i.e. the follower coefficient $R_2$. The operation circuit 94, based on the after-touch control signal AT″ which is outputted at such time and also on the follower coefficient $R_2$, makes the adding operation to provide a fresh after-touch control signal AT″. Since the follower coefficient $R_2$ is a positive coefficient smaller in value than the follower coefficient $R_1$, the after-touch control signal AT″ augments gradually. When, subsequently, the after-touch control signal AT″ has become equal to the corrected after-touch signal AT′, a coincidence signal EQ is outputted from the comparator 93, and the follower coefficient "0" is selected. Thereafter, by circuit behaviors similar to those described above, the after-touch control signal AT″ will undergo a variation as shown in FIG. 5 while following the corrected after-touch signal AT′. In such a follow-up variation of the after-touch control signal AT″, the signal AT″ preferably exhibits a relatively quick follow-up at the time of uprising of the signal but follows relatively slowly at the time of falling of the signal. Therefore, each of the follower coefficients $R_1$ and $R_2$ is selected at a value greater than $|R_3|$.

The after-touch control signal AT″ outputted from the after-touch control circuit 9 is multiplied, at the multiplier 12, with the envelope waveshape supplied from the envelope generator 11, to thereby control the envelope waveshape. The envelope waveshape which has been subjected to after-touch control and which is outputted from this multiplier 12 is supplied to the musical tone signal generation circuit 4 to be used for controlling, for example, the tone volume of the musical tone signal. The musical tone signal which has thus been subjected to after-touch control is delivered to a sound system 6 which is comprised of, for example, an amplifier and a loudspeaker, and is generated as a musical tone.

As discussed above, by controlling the musical tone corresponding to the initial touch at the onset of a key depression, and thereafter by controlling the musical tone correspondingly to the after touch, it is possible to correct the delay in the rise of the sounding of the musical tone at the onset of the key depression, and thus a natural musical tone can be obtained.

It should be noted here that, in place of correcting an envelope waveshape by an after-touch control signal AT″, arrangement may be provided so that the after-touch control signal AT″ is added directly to the musical tone signal generation circuit 4, to thereby control, for example, the tone color, the tone pitch and the modulation effect of the musical tone signal.

In the embodiment shown in FIG. 2, the followability is controlled by the selection from among different follower coefficients. Other than this method, a constant follower coefficient may be used with the mathematical operation timing being varied, or alternatively both the follower coefficient and the operation timing may be varied.

Figure 6:
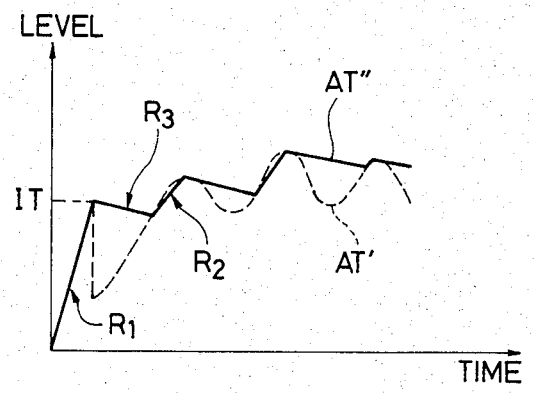
FIG. 6 is a diagram showing another example of output waveshape of the after-touch control circuit.

Also, in the above-described embodiment, after the after-touch control signal AT″ has arrived at an aimed (target) value, i.e. at a corrected after-touch signal AT′, its value is held for a predetermined length of time. However, as shown in FIG. 6, control may be made so that, immediately after the after-touch control signal AT″ has arrived at an aimed value, it is made to follow the after-touch detection signal AT. To this end, it is only necessary to arrange, as shown by broken line in FIG. 2, that when a coincidence signal EQ is outputted from the comparator 93, the flip-flop 904 of the after-touch data correction circuit 90 is reset.

Figure 7:
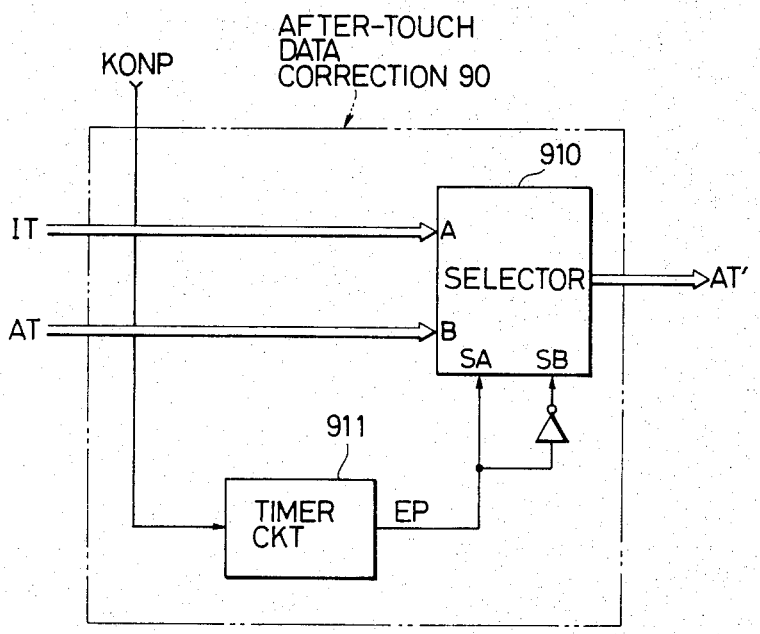
FIG. 7 is a block diagram showing the circuit arrangement of another example of the after-touch data correction circuit shown in FIG. 2.

FIG. 7 is another embodiment of the after-touch data correction circuit 90 shown in FIG. 3. This embodiment is arranged so that a corrected after-touch signal AT′ is outputted independently for each channel.

The after-touch data correction circuit 90 in this instant embodiment is comprised of a selector 910 which inputs to its terminal A and terminal B the initial touch detection signal IT and the after-touch detection signal AT, respectively, which are supplied time-divisionally for each channel, and a timer circuit 911 which outputs a timer end signal EP time-divisionally independently for each channel at the end of the lapse of a predetermined length of time after a key-on pulse signal KONP is generated in each channel. The after-touch control circuit 9 in case such an after-touch data correction circuit 90 as mentioned above is employed will become as shown in FIG. 8. That is, in lieu of the delay circuit 95 in the embodiment of FIG. 2, there is provided a shift register 101 which is driven by a clock $\phi$ intended to determine a channel timing and which has stages equal in number to the channels, and also, in place of the flip-flop 100, there are provided a shift register 102 similar to the shift register 101 and, on its input side, an AND gate $G_3$ and an OR gate $G_4$. The other arrangement is exactly the same as that shown in FIG. 2. Accordingly, like reference numerals as those in FIG. 2 are assigned.

Figure 8:
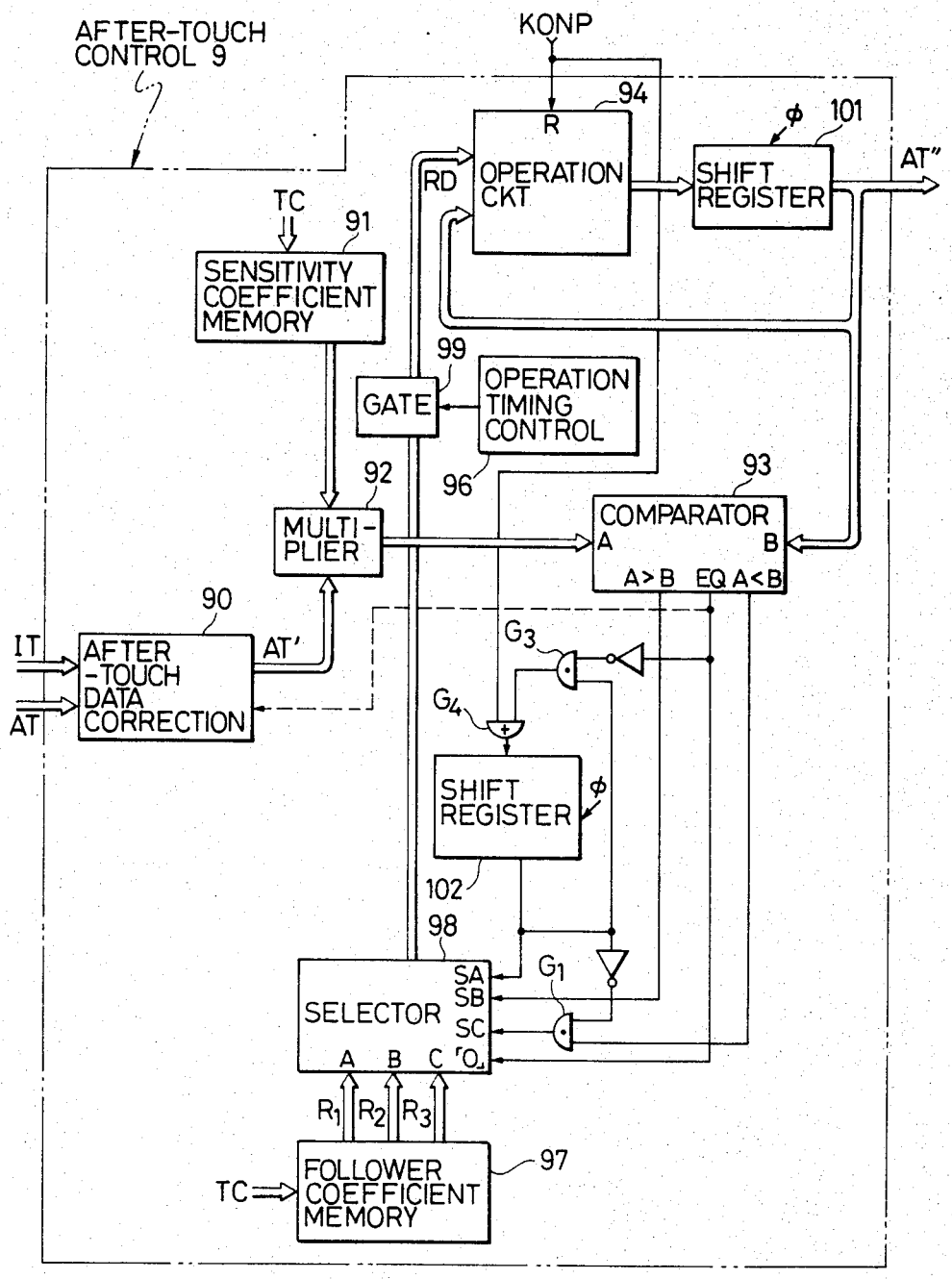
FIG. 8 is a block diagram showing the circuit arrangement of another example of the after-touch control circuit constructed by the use of the after-touch data correction circuit shown in FIG. 7.

In the embodiment of FIG. 8, an after-touch control signal AT″ is formed and outputted time-divisionally for each channel. The shift register 102 outputs a "1" signal throughout the period of time from the time when a key-on pulse signal KONP is outputted in each channel up to the time when a first coincidence signal EQ is outputted from the comparator in the pertinent channel. The other circuit behaviors are the same as those in the embodiment of FIG. 2, and accordingly their description is omitted.

In the above-described embodiments shown in FIGS. 2 and 8, it should be understood that, in place of performing the setting of the initial value of the after-touch control signal AT″ in correspondence to the initial touch detection signal IT, the initial setting may be performed by using an appropriate fixed value such as a value corresponding to, for example, a mezzo forte (mf). The fixed value at such an instance may be set so as to correspond to a tone color, or it may be set independently of the tone color.

What is claimed is:

1. A touch responsive apparatus for an electronic musical instrument, comprising:

key depression detection means for detecting that a key is depressed on a keyboard;

after-touch detection means for detecting an after-touch representing a key touch after the key has been depressed and for outputting an after-touch detection signal;

target value generation means for generating, upon key depression, a first target value of a certain tangible value which is independent of said after-touch detection signal and for successively generating a second target value which corresponds to said after-touch detection signal; and after-touch control signal generation means for generating an after-touch control signal which rises up toward said first target value without causing a click in a musical tone of said musical instrument and thereafter follows said second target value, the musical tone of said musical instrument being controlled in accordance with said aftertouch control signal.

2. A touch responsive apparatus according to claim 1, wherein:

said apparatus further comprises initial touch detection means for detecting an initial touch representing a key touch up to the completion of a key depression, and said target value generation means outputs in response to said initial touch detection means the first target value which corresponds to an initial touch detection signal detected by said initial touch detection means.

3. A touch responsive apparatus according to claim 1 wherein:

said target value generation means comprises timer means for causing said first target value to be outputted only for a predetermined length of time after key depression.

4. A touch responsive apparatus according to claim 3, wherein:

said target value generation means comprises changeover means for causing said second target value to be outputted when the after-touch detection signal reaches said first target value even before said predetermined length of time elapses.

5. A touch responsive apparatus according to claim 1 wherein:

said after-touch control signal generation means has sensitivity correction means for performing a sensitivity correction of the after-touch control signal by a sensitivity coefficient corresponding to a tone color prior to outputting said after-touch control signal which varies following either of said first and second target values.

6. A touch responsive apparatus according to claim 1 wherein:

said after-touch control signal generation means comprises follow rate control means which provides a first follow coefficient for determining a follow rate when the after-touch control signal varies toward said first target value, a second follow coefficient for determining a follow rate when the after-touch control signal follows said second target value in an increasing state and a third follow coefficient for determining a follow rate when the after-touch control signal follows said second target value in a decreasing state, the first coefficient being greatest and the second coefficient being greater than the third coefficient in absolute value.

7. A touch responsive apparatus according to claim 1, wherein:

said after-touch detection means is provided separately for each key to detect respective after-touches of plural keys depressed simultaneously, and said after-touch control signal generation means generates an after-touch detection signal time-divisionally for each depressed key.

8. A touch responsive apparatus for an electronic musical instrument, comprising:

key depression means for detecting that a key is depressed on a keyboard;

after-touch detection means for detecting an after-touch representing a key touch after the key has been depressed and for outputting an after-touch detection signal;

target value generation means for generating a certain aimed value; and after-touch control signal generation means responsive to said key depression detection means and to said after-touch detection means for outputting an after-touch control signal which rises up toward said aimed value to such an extent as will not generate a click and thereafter varies based on said after-touch detection signal, a musical tone of said electronic musical instrument being controlled by said after-touch control signal.

9. A touch responsive apparatus for an electronic musical instrument, comprising:

key depression detection means for detecting that a key has been depressed on a keyboard;

initial target value generation means for generating, upon initial key depression, a target value corresponding to said initial key depression;

after-touch signal generating means for generating an after-touch signal corresponding to a key touch after the key has been depressed;

after touch control means for producing an adjusted after-touch control signal at the first to occur of (a) the time when a predetermined length of time has elapsed after said initial key depression, and (b) at the time when said after-touch signal becomes greater than said initial target value.

* * * * *

UNITED STATES PATENT AND TRADEMARK OFFICE

CERTIFICATE OF CORRECTION

PATENT NO. : 4,528,885

DATED : July 16, 1985

INVENTOR(S) : Chihana

It is certified that error appears in the above-identified patent and that said Letters Patent is hereby corrected as shown below:

Claim 8, third line (column 10, line 17), after "key depression" insert --detection--.

Signed and Sealed this

*Thirty-first* Day of *December 1985*

[SEAL]

*Attest:*

DONALD J. QUIGG

*Attesting Officer*

*Commissioner of Patents and Trademarks*